US008384502B2

(12) United States Patent
Gao

(10) Patent No.: US 8,384,502 B2
(45) Date of Patent: Feb. 26, 2013

(54) CIRCUIT BREAKER

(75) Inventor: Shaohua Gao, Pinghu (CN)

(73) Assignee: Zhejiang Trimone Electric Science & Technology Co. Ltd., Pinghu (CN)

( * ) Notice: Subject to any disclaimer, the term of this patent is extended or adjusted under 35 U.S.C. 154(b) by 259 days.

(21) Appl. No.: 12/780,881

(22) Filed: May 15, 2010

(65) Prior Publication Data

US 2011/0011714 A1 Jan. 20, 2011

(30) Foreign Application Priority Data

Jul. 16, 2009 (CN) ..... 2009 1 0100664

(51) Int. Cl.

| | |
|---|---|
| ***H01H 75/00*** | (2006.01) |
| ***H01H 73/12*** | (2006.01) |
| ***H01H 73/00*** | (2006.01) |
| ***H01H 83/06*** | (2006.01) |

(52) U.S. Cl. ..... 335/18; 361/42

(58) Field of Classification Search ..... 335/18; 361/42–51

See application file for complete search history.

(56) References Cited

U.S. PATENT DOCUMENTS

| | | | | |
|---|---|---|---|---|
| 6,828,886 | B2 | 12/2004 | Germain et al. | |
| 7,098,761 | B2 * | 8/2006 | Germain et al. | 335/18 |
| 7,116,191 | B2 * | 10/2006 | Wang | 335/18 |
| 7,195,500 | B2 * | 3/2007 | Huang et al. | 439/107 |
| 7,492,558 | B2 | 2/2009 | Germain et al. | |
| 7,633,726 | B2 * | 12/2009 | Huang et al. | 361/42 |
| 7,683,745 | B2 | 3/2010 | Gouhl et al. | |
| 2005/0012575 | A1 * | 1/2005 | Huang et al. | 335/18 |
| 2005/0286183 | A1 * | 12/2005 | Germain | 361/42 |
| 2006/0238933 | A1 * | 10/2006 | Huang et al. | 361/42 |
| 2007/0076337 | A1 * | 4/2007 | Huang | 361/42 |
| 2008/0170341 | A1 * | 7/2008 | Huang et al. | 361/42 |
| 2009/0086389 | A1 * | 4/2009 | Huang et al. | 361/42 |
| 2009/0091869 | A1 * | 4/2009 | Huang et al. | 361/42 |
| 2009/0161271 | A1 * | 6/2009 | Huang et al. | 361/42 |

* cited by examiner

*Primary Examiner* — Mohamad Musleh
(74) *Attorney, Agent, or Firm* — Mei & Mark LLP

(57) ABSTRACT

A circuit breaker, may comprise a circuit board, a resetting button, a tripping button, a lock pin and an elevator. The resetting button may comprise a locking device with a resetting drawbar having a resetting spring on an upper portion, a tripping spring on a middle portion, and a hook at a lower end. A lock pin below the resetting drawbar, may comprise a lock pin slope for selectively contacting the hook. The tripping button may comprise a tripping device configured to selectively contact the locking device. The tripping device may comprise a tripping block, a loosening block slope configured to selectively contact the lock pin slope, and a moveable spring between the tripping block and the circuit board. The elevator may house the portion of the resetting drawbar covered by the tripping spring, and the hook may align with the bottom of the elevator.

18 Claims, 10 Drawing Sheets

CIRCUIT BREAKER

This application claims the benefit of priority of Chinese patent application 200910100664.4, filed Jul. 16, 2009, the content of which is incorporated herein by reference in its entirety.

TECHNICAL FIELD

The present disclosure relates generally to a circuit breaker. A circuit breaker may be used in power supplies of various equipment and systems such as electrical appliances, instruments, and devices.

BACKGROUND

Current electrical appliances, instruments, devices, equipment and systems have a power input end, which can be connected with a power supply. The power supply has a load end, which can be connected with one or more loads. Between the input end and the load end, there is at least one route for an inductive circuit. If, when using the power supply, the power input end is used as the load end by mistake, or if the load end is used as the power input end by mistake, or if the grounding fails, the above mentioned electrical equipment or device may be destroyed, or even a fire may occur, endangering personal safety. Therefore, in case of circuit failure or incorrect wiring, it is quite important to break the circuit right away.

The existing circuit breaker has a structural defect. When it breaks the circuit in the case of a circuit failure, the resetting button on it can still be pressed for resetting, causing damage to the electrical equipment.

In addition, the existing circuit breaker normally adopts electrical tripping. After the circuit is broken, power is no longer supplied, and so the electrical tripping can not be carried out.

SUMMARY

A circuit breaker is provided which can ensure timely tripping under any circumstances. Moreover, in case of any failure in the circuit, the resetting button can not be pressed down and the tripped status can be maintained.

In one embodiment, a circuit breaker may comprise a circuit board, a resetting button, a lock pin, a tripping button, and an elevator. The resetting button may comprise a locking device. The locking device may comprise a resetting drawbar having an upper portion, a middle portion, and a lower end. A hook may be at the lower end of the resetting drawbar. A resetting spring may be on the upper portion of the resetting drawbar. A tripping spring may be on the middle portion of the resetting drawbar.

A lock pin below the resetting drawbar may comprise a lock pin slope. The lock pin may be configured to selectively contact the hook.

A tripping button may comprise a tripping device configured to selectively contact the locking device. The tripping device may comprise a tripping block, a loosening block slope configured to selectively contact the lock pin slope, and a moveable spring between the tripping block and the circuit board.

An elevator may have an upper edge and a bottom edge. The elevator may house the portion of the resetting drawbar covered by the tripping spring. The hook may align with the bottom of the elevator.

The circuit breaker makes mechanical tripping possible through the action of a tripping device on a locking device.

This ensures timely tripping under any circumstance by avoiding a situation where tripping can not be carried out when the power to the circuit is off. In the case of any failure in the circuit, the resetting button can not be pressed down, and the tripping status is maintained to protect the circuit.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DETAILED DESCRIPTION

Reference will now be made in detail to the present exemplary embodiments, examples of which are illustrated in the accompanying drawings. Wherever possible, the same reference numbers will be used throughout the drawings to refer to the same or like parts.

Figure 1A:
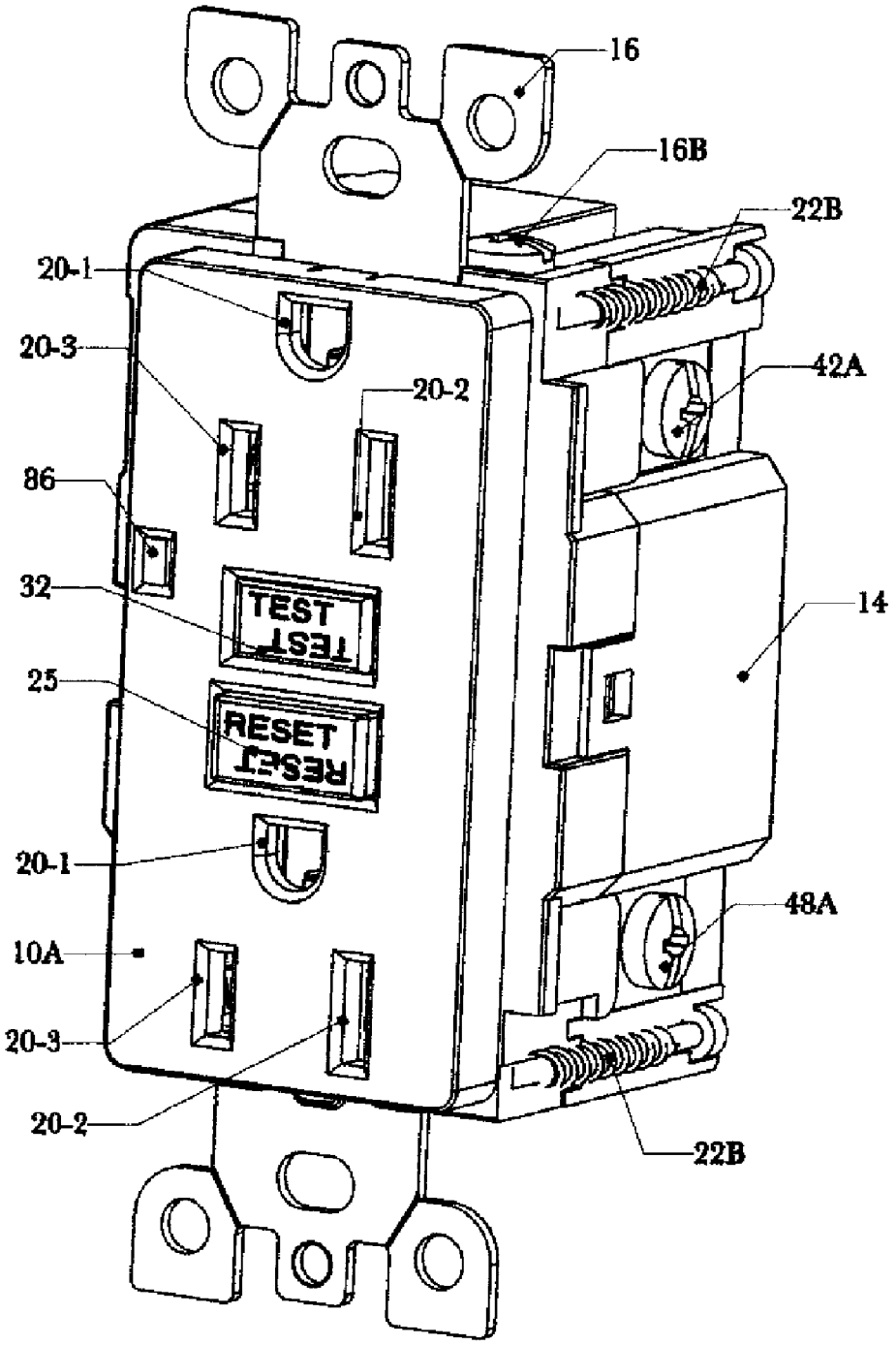
FIG. 1A is an example of a power supply with a 15A upper cover.

As shown in FIG. 1A, a power supply consists of a 15A upper cover 10A, and a base 14. A grounding rack 16 is provided between base 14 and 15A upper cover 10A. The 15A upper cover 10A is connected to base 14 through four assembly screws 22B.

Figure 1B:
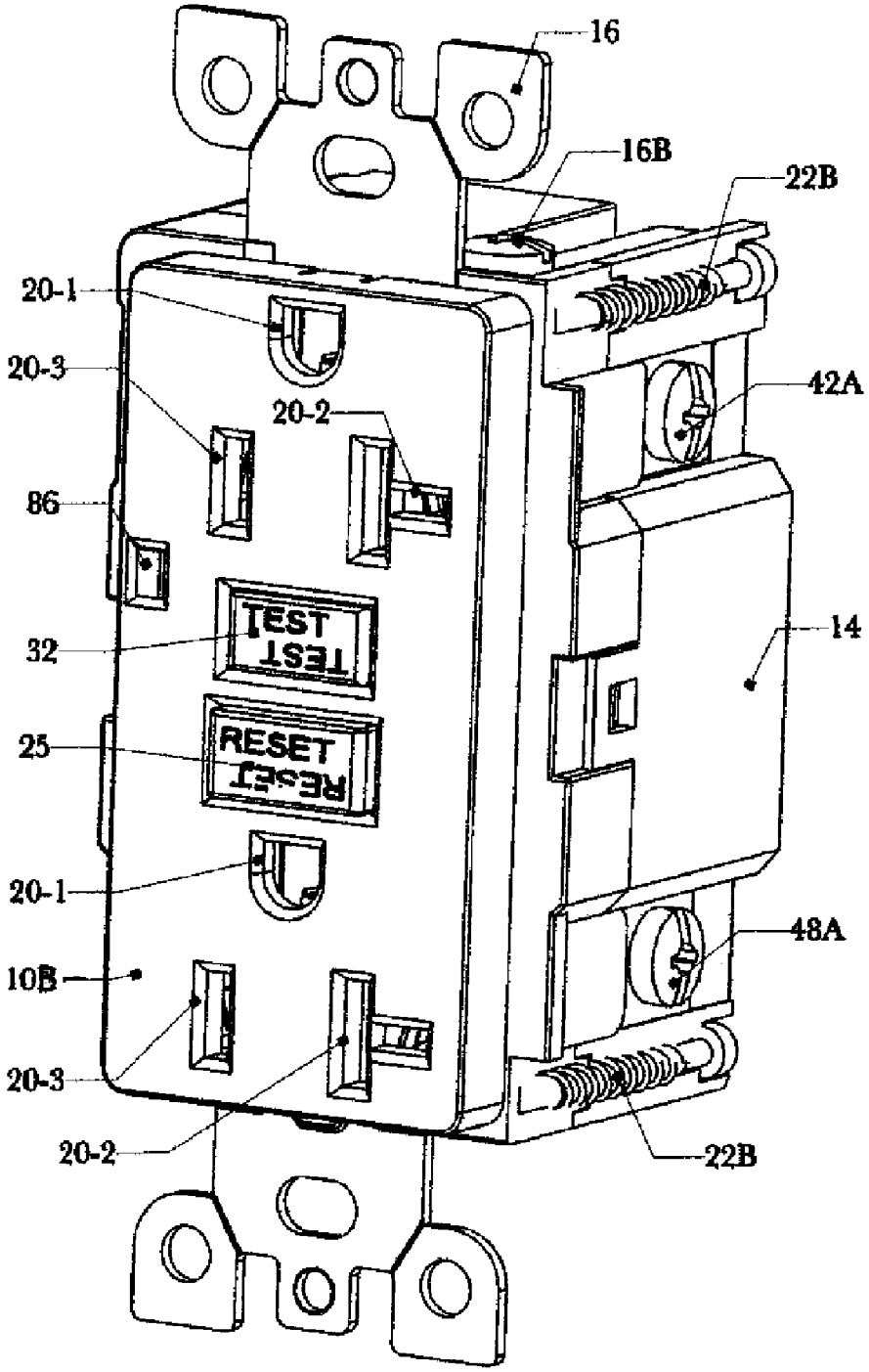
FIG. 1B is an example of a power supply with a 20A upper cover.

In FIG. 1B, a 20A upper cover 10B is used.

Figure 2:
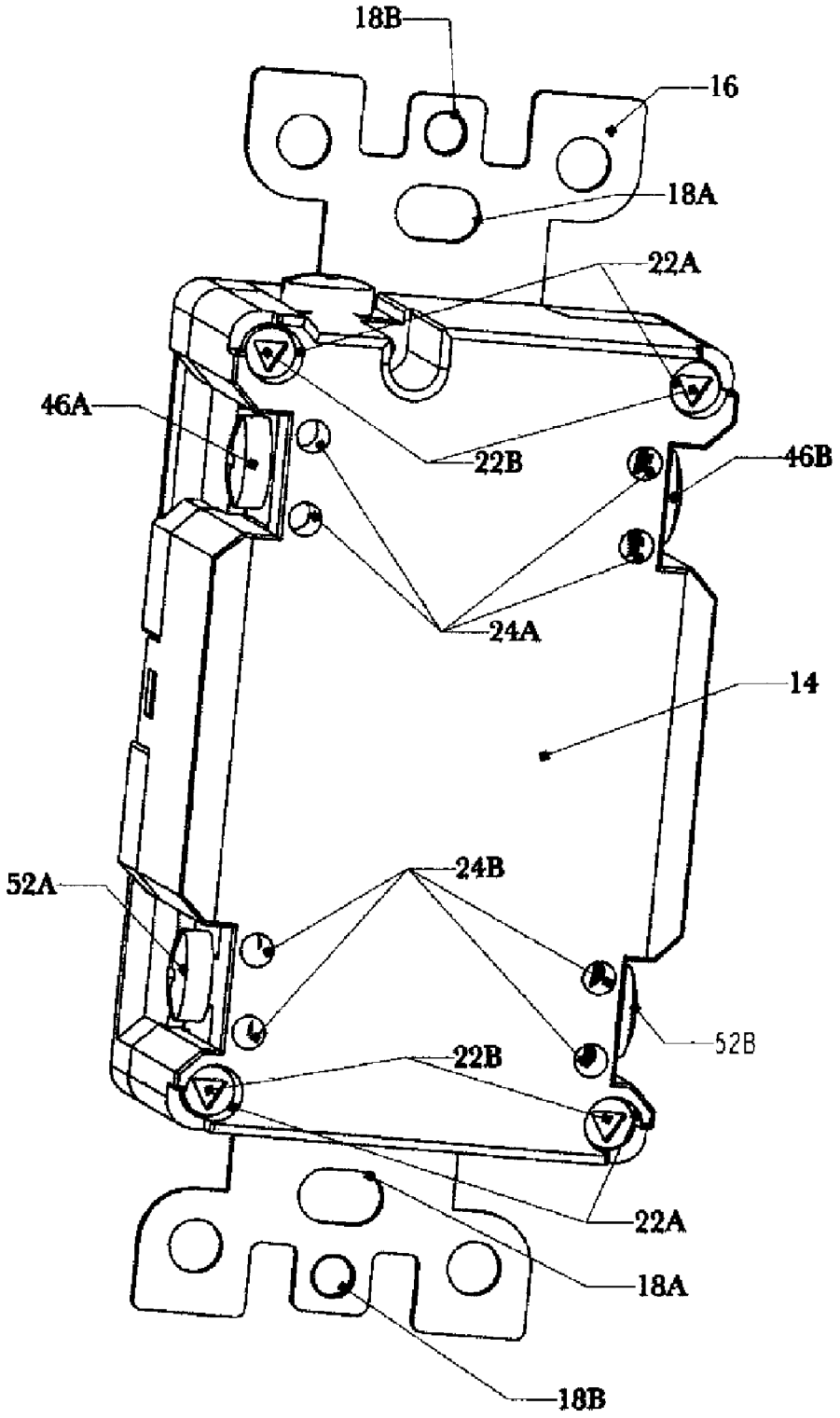
FIG. 2 is an example of a rear part of a power supply.

As shown in FIG. 2, four assembly screws 22B are inserted in the four assembly holes 22A in the base for securing a connection to one of 15A upper cover 10A or 20A upper cover 10B.

The resetting button 25 and tripping button 32 provided on base 14 may penetrate 15A upper cover 10A and 20A upper cover 10B. 15A upper cover 10A and 20A upper cover 10B are each provided with two upper cover grounding holes 20-1, two neutral plug holes 20-2, and two phase plug holes 20-3. Dual-color indicators 86 on base 14 penetrate through 15A upper cover 10A and 20A upper cover 10B.

Figure 3:
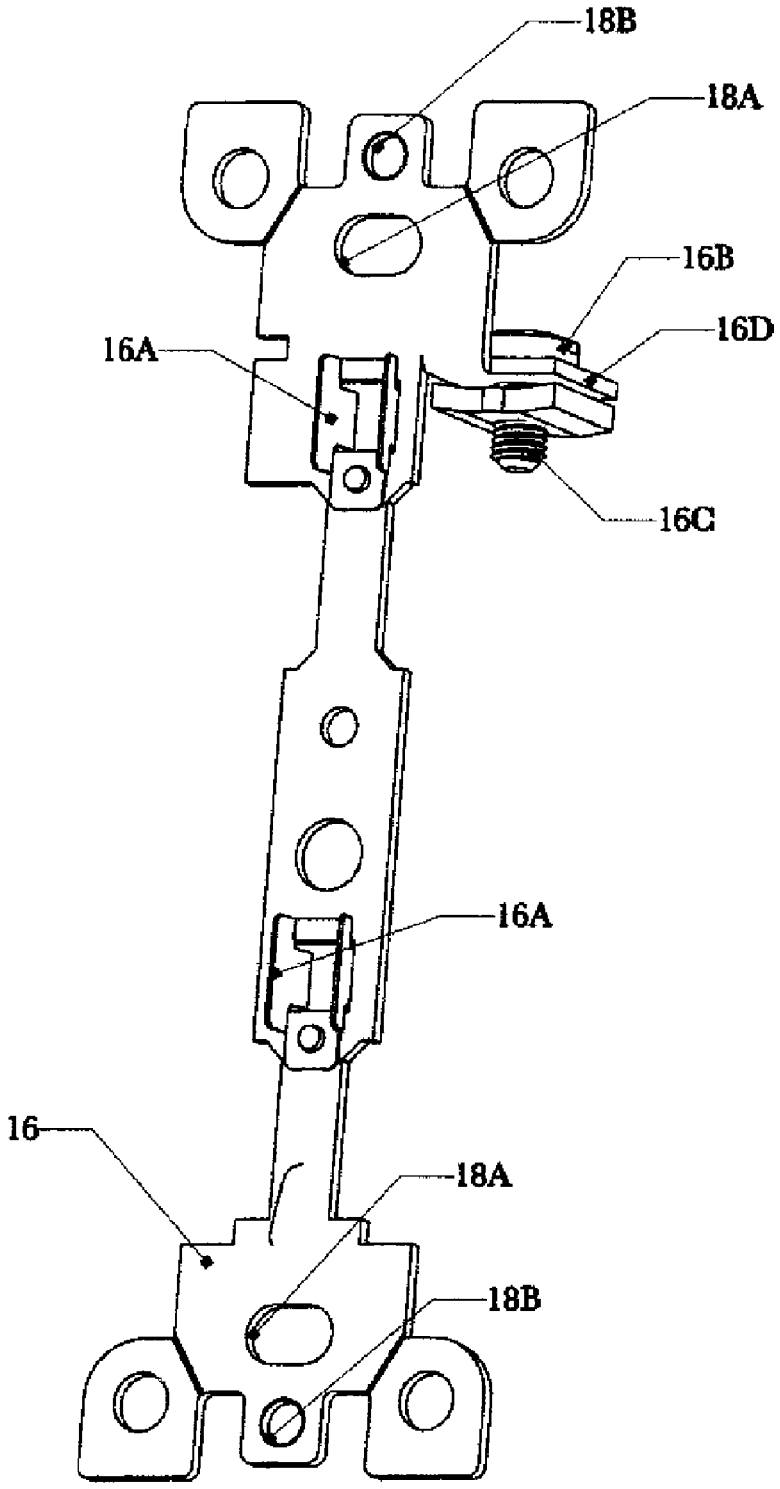
FIG. 3 is an example of a grounding rack.

As shown in FIG. 3, grounding rack 16 is provided with grounding attachment 16A, grounding screw 16B, grounding strip 16C, grounding post 16D, mounting hole 18A, and panel mounting hole 18B.

Figure 4:
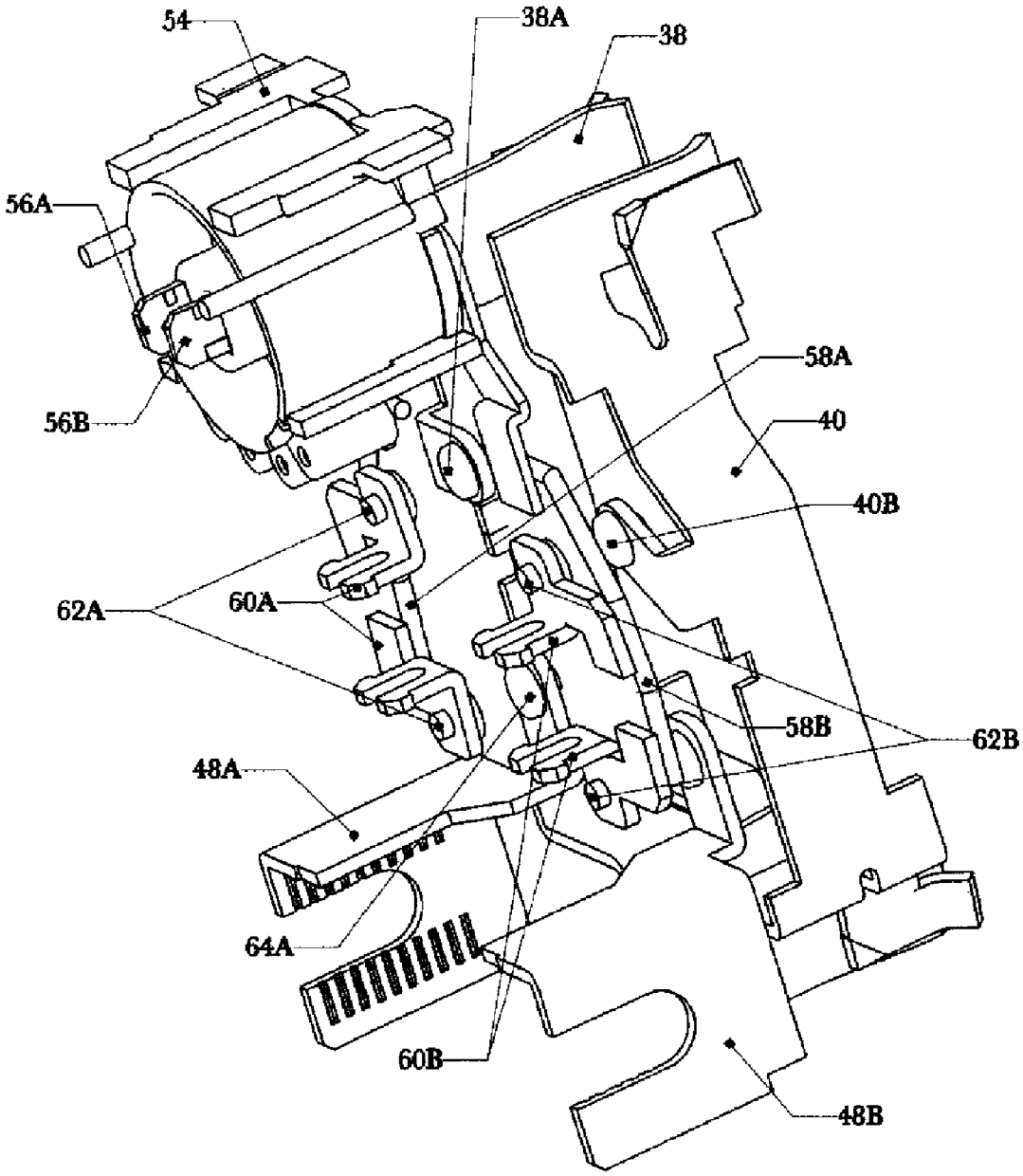
FIG. 4 is an example of an internal structure of a power supply without a resetting button or tripping button present.
Figure 5:
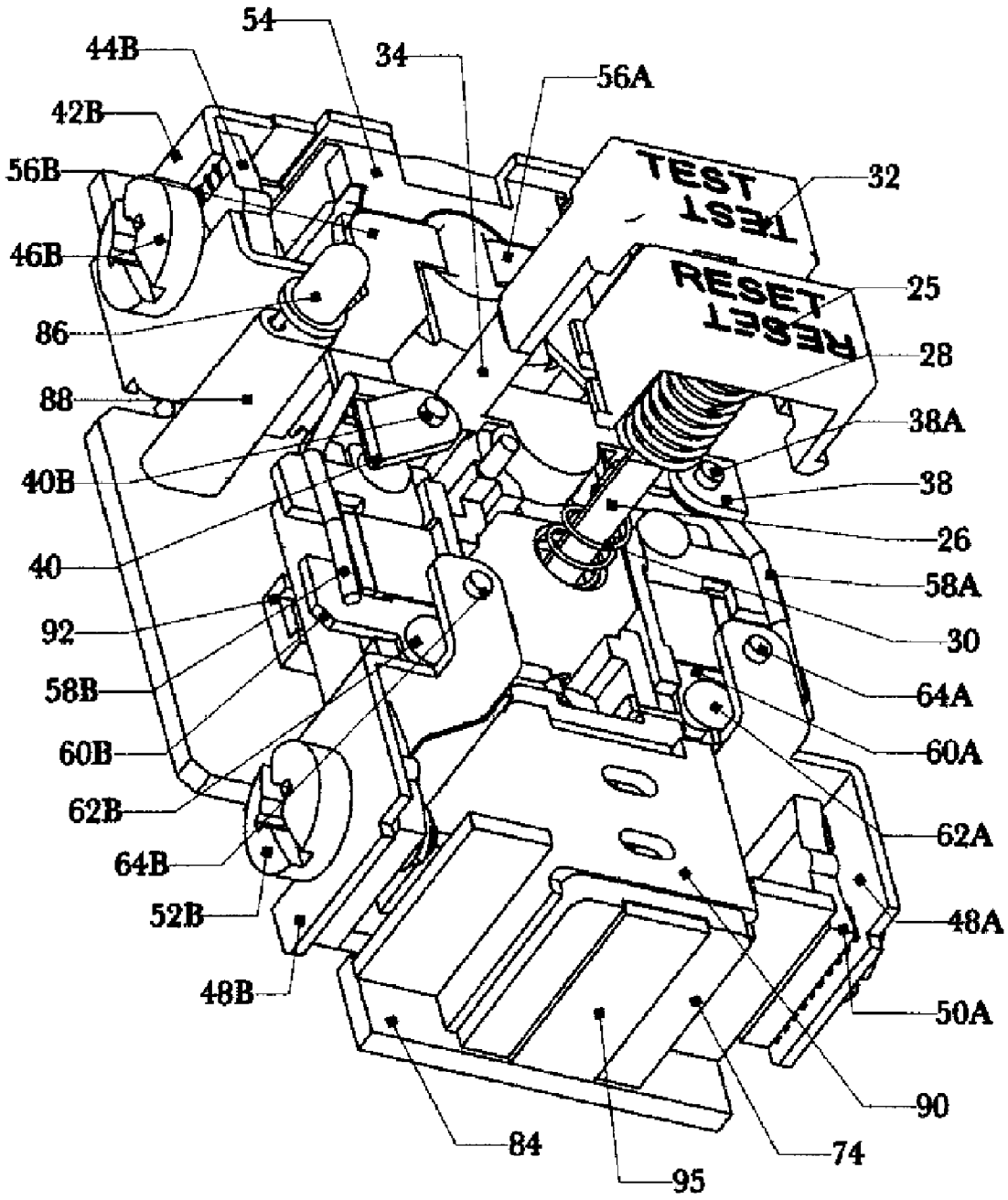
FIG. 5 is an example of an internal structure of a power supply with a resetting button and tripping button present.

As shown in FIGS. 4 and 5, left plug bush 40 is provided in both sides of circuit board 84 to connect circuit board 84 to base 14. Circuit board 84 is provided with an assembled magnet set 54. Assembled magnet set 54 is provided with first input conductive part 56A and second conductive part 56B. An elevator 68 is provided with a first input moveable contact wall 60A connected with first input conductive part 56A through a first input conductive wire 58A. Elevator 68 is also provided with a second input moveable contact wall 60B connected with second input conductive part 56B through a second input conductive wire 58B. First input moveable contact wall 60A is provided with two first input movable contacts 62A. Second input moveable contact wall 60B is provided with two second input movable contacts. Base 14 is connected through a clamp with a first output static contact 64A, which corresponds to and is associated with first input moveable contact 62A. Base 14 is connected through a clamp with a second output static contact 64B, which corresponds to and is associated with second input moveable contact 62B. The electrification of the power supply is stable and the electrifying rate is high.

As shown in FIG. 5 thru FIG. 9, base 14 is provided with circuit board 84, and circuit board 84 is provided with resetting button 25 and tripping button 32. Resetting button 25 is provided with a locking device. Tripping button 32 is provided with a tripping device corresponding to the locking device. Locking device includes a resetting drawbar 26 with a hook 102 at the lower end, which is provided under the resetting button 25. Resetting drawbar 26 is covered with a resetting spring 28 at the upper part and is covered with a tripping spring 30 at the middle part.

Locking device may comprise a strip of material configured so that resetting drawbar 26 is parallel to a lower end of hook 102. Hook 102 may perpendicularly interpose resetting drawbar 26 and lower end of hook 102 such that the parallel portions are offset by hook 102, and hook 102 forms a ledge on both sides of the strip of material.

Resetting drawbar 26 and tripping spring 30 are provided in elevator 68. Hook 102 corresponds to the bottom of elevator 68. Below resetting drawbar 26, metal lock pin 72 corresponding to hook 102 is provided. At the front end, metal lock pin 72 is provided with a lock pin slope 100.

Tripping device includes tripping block 34 with loosening block slope 98, which is provided below tripping button 32. Tripping device also includes moveable spring 36, which is provided between tripping block 34 and circuit board 84. Loosening block slope 98 corresponds with lock pin slope 100. Mechanical tripping is made possible with the action of tripping device on the locking device. This ensures timely tripping by avoiding the phenomenon that electrical tripping can not be carried out when power to the circuit breaker is off.

Circuit board 84 is provided with a retractable device connected to metal lock pin 72. Retractable device includes piston 78 connected with metal lock pin 72. Circuit board 84 is provided with mounting device bracket 66 for assembling piston 78. Circuit board 84 is also provided with coil rack 74. Between coil rack 74 and mounting device bracket 66, piston spring 80 connected with piston 78, is provided. Piston spring 80 is covered with solenoid coil 76. The retractable device operates the metal lock to move the metal lock forward and backward.

Metal lock pin 72 is provided with a notch, into which the lower end of hook 102 is inserted. Lock bracket 92 is provided on circuit board 84 below metal lock pin 72. Lock bracket 92 is provided with a lock moveable contact spring 82A and a lock static contact spring 82B. Lock moveable contact spring 82A corresponds to lower end of hook 102.

When the lower end of hook 102 separates from lock moveable contact spring 82A, it is called the first position. When the lower end of hook 102 contacts lock moveable contact spring 82A, it is called the second position. When the lower end of hook 102 is attached to the bottom of elevator 68, it is called the third position. Hook 102 moves among the first position, the second position, and the third position.

Figure 6:
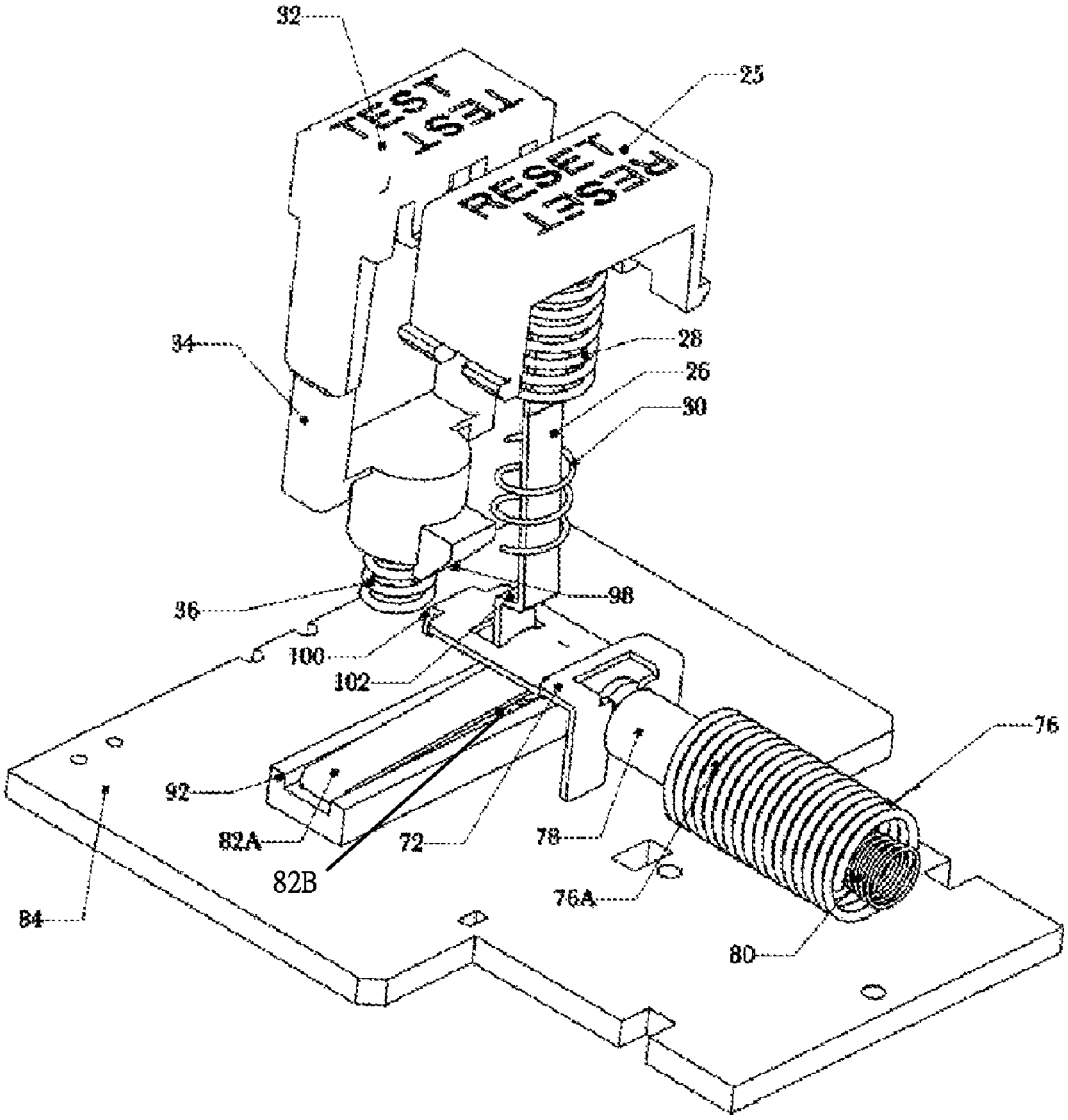
FIG. 6 is an example of a circuit breaker after tripping.
Figure 7:
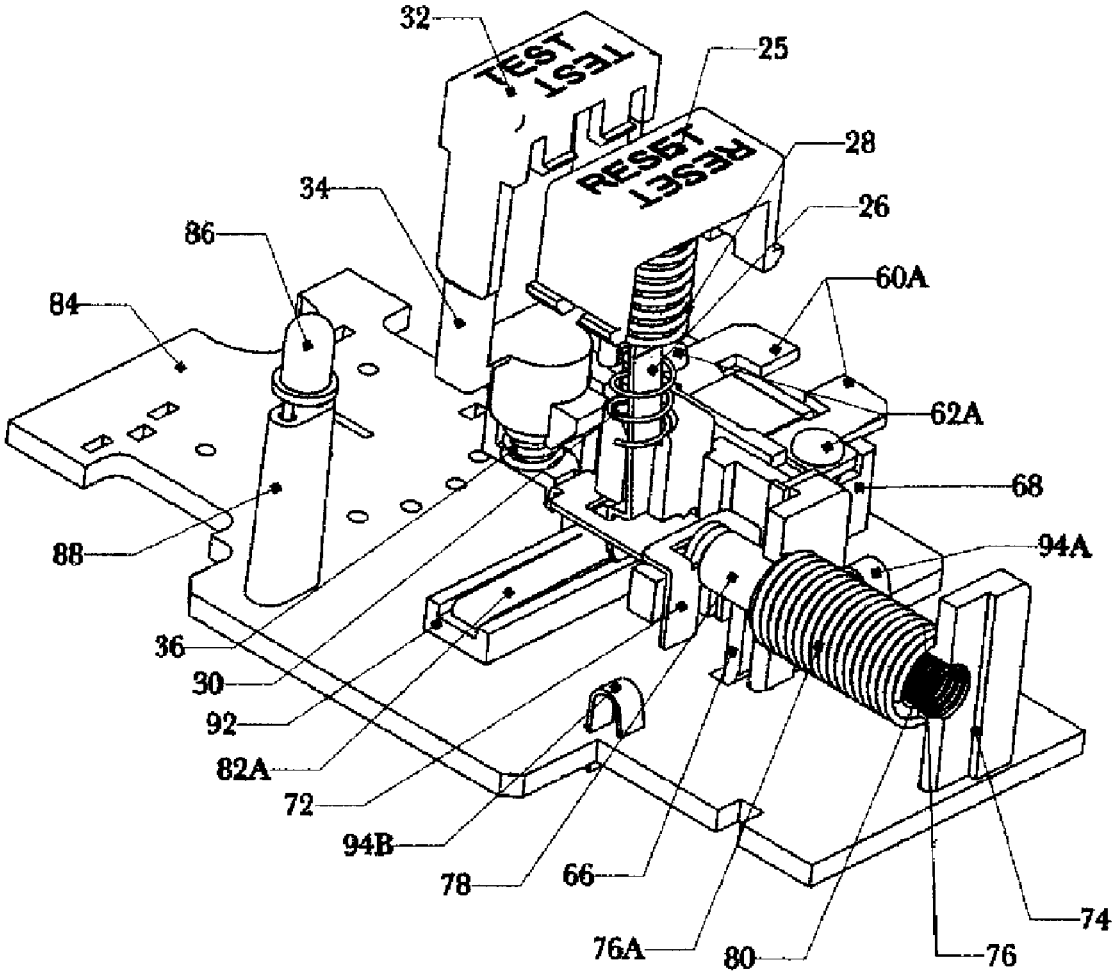
FIG. 7 is an example of a circuit breaker after a resetting button has been pressed.
Figure 8:
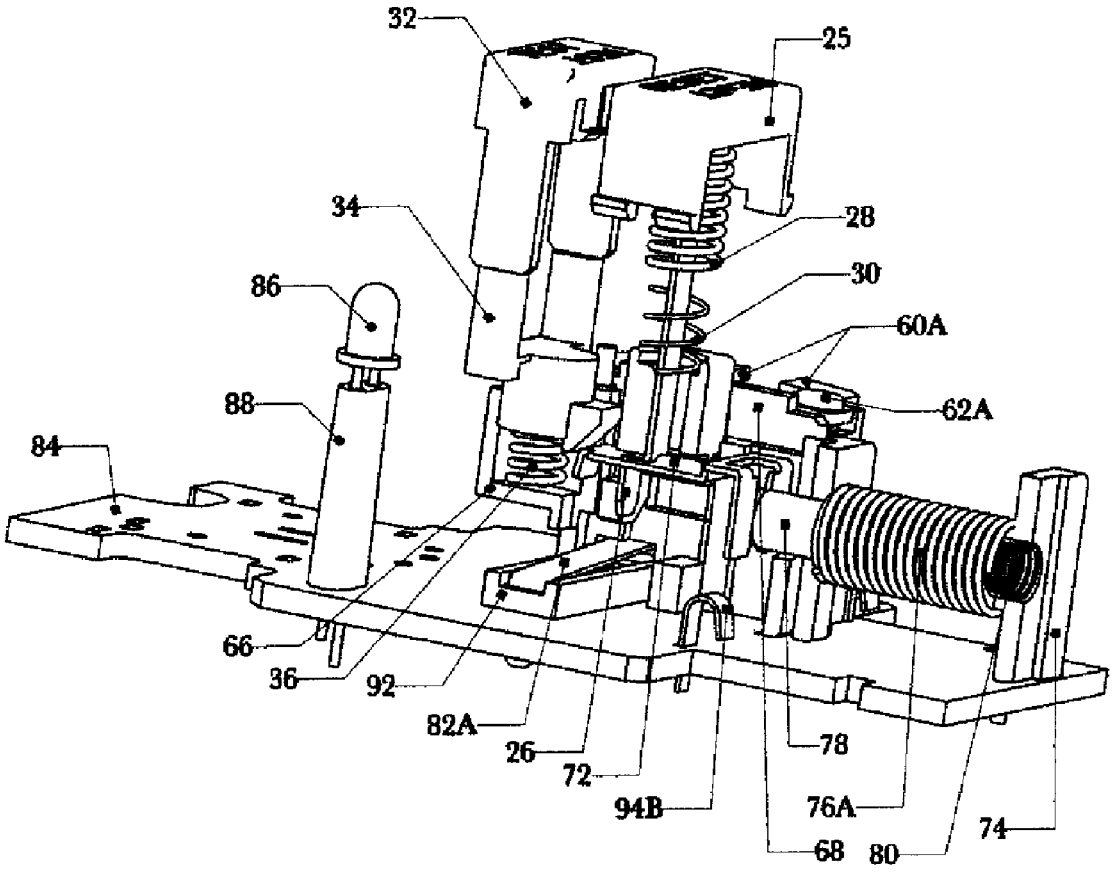
FIG. 8 is an example of a circuit breaker after resetting.

During operation, as shown in FIG. 6, a structural schematic diagram of a circuit breaker is shown after tripping. As shown in FIG. 7, when resetting button 25 is pressed down under the normal electrification conditions, resetting drawbar 26 of resetting button 25 moves downwards, making lock moveable contact spring 82A contact with lock static contact spring 82B. In response to the contact, via communication means not shown, solenoid coil 76 is electrified, driving metal lock 72 to move backwards. Resetting drawbar 26 may now continue to move downwards and pass through the notch on metal lock 72. Solenoid coil 76 is then de-energized. Metal lock 72 recovers elastically under the action of piston spring 80, making the lower end hook 102 of resetting drawbar 26 match with the bottom of elevator 68 to reset to the status shown in FIG. 8. If the circuit is not electrified due to failure, the retractable device does not move. Metal lock 72 obstructs resetting button 25, making it unable to be pressed down.

Figure 9:
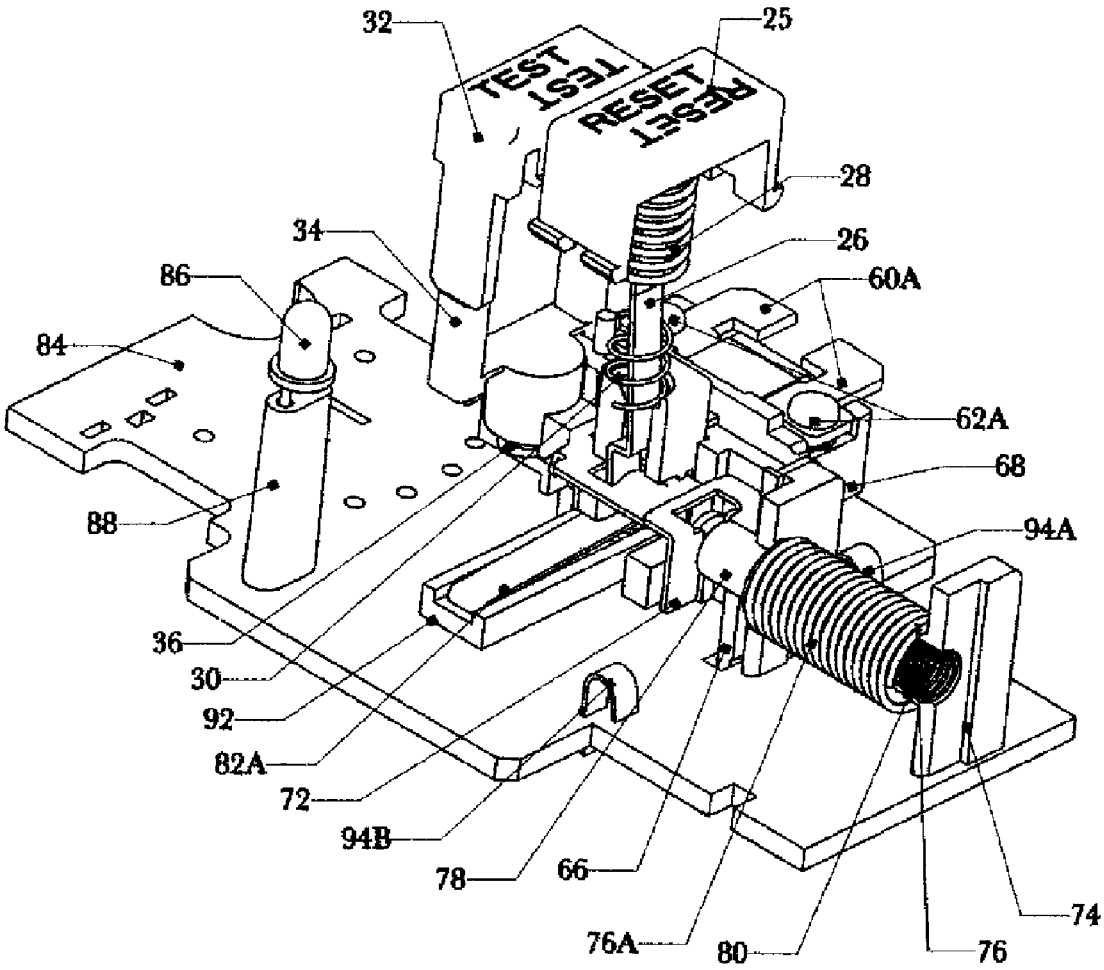
FIG. 9 is an example of a circuit breaker after the tripping button has been pressed.

As shown in FIG. 9, when pressing down tripping button 32, tripping block 34 is driven to move downwards. Loosening block slope 98 on tripping block 34 acts with lock slope 100 on metal lock 72, making metal lock 72 move backwards. Hook 102 under resetting drawbar 26 separates from the bottom of elevator 68. Under the action of resetting spring 28, resetting drawbar 26 drives resetting button 25 to move upwards to the original position. Mechanical tripping via the TEST tripping button 32 ensures timely tripping by avoiding the phenomenon that electrical tripping can not be carried out when power is off.

In the preceding specification, various preferred embodiments have been described with reference to the accompanying drawings. It will, however, be evident that various other modifications and changes may be made thereto, and additional embodiments may be implemented, without departing from the broader scope of the invention as set forth in the claims that follow. The specification and drawings are accordingly to be regarded in an illustrative rather than restrictive sense.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

I claim:

1. A circuit breaker, comprising:

a circuit board;

a resetting button comprising:

a locking device, the locking device comprising:

a resetting drawbar having an upper portion, a middle portion, and a lower end;

a hook at the lower end of the resetting drawbar;

a resetting spring on the upper portion of the resetting drawbar; and a tripping spring on the middle portion of the resetting drawbar;

a lock pin below the resetting drawbar, the lock pin comprising:

a one piece horizontal portion with a lock pin slope;

a tripping button comprising:

a tripping device configured to selectively unlock the locking device, the tripping device comprising:

a one piece tripping block with a loosening block slope, the loosening block slope configured to selectively contact the lock pin slope; and a moveable spring between the tripping block and the circuit board; and an elevator having an upper edge and a bottom edge, wherein the elevator houses the portion of the resetting drawbar covered by the tripping spring, and the hook aligns with the bottom of the elevator, and wherein the lock pin slope extends downward away from the horizontal portion and the horizontal portion selectively contacts the hook.

2. The circuit breaker of claim 1, further comprising:

a retractable device comprising a piston;

a mounting bracket for assembling the piston;

a coil rack;

a piston spring between the coil rack and the mounting bracket; and a solenoid coil covering the piston spring, wherein the piston connects to the lock pin and the piston spring connects to the piston.

3. The circuit breaker of claim 1, further comprising:

a lock bracket below the lock pin;

a lock moveable contact spring in the lock bracket; and a lock static contact spring in the lock bracket, wherein the lock pin further comprises a notch and the lower end of the hook passes through the notch.

4. The circuit breaker of claim 3, wherein:

the lower end of the hook is in a first position when the lower end of the hook is separated from the lock moveable contact spring, the lower end of the hook is in a second position when the lower end of the hook contacts the lock moveable contact spring, and the lower end of the hook is in a third position when the lower end of the hook is attached to the bottom of the elevator.

5. The circuit breaker of claim 1, further comprising:

an assembled magnet set comprising a first input conductive part and a second input conductive part;

a first input moveable contact wall on the elevator, the first input moveable contact wall comprising at least two first input moveable contacts;

a first input conductive wire;

a second moveable contact wall on the elevator, the second moveable contact wall comprising at least two second input moveable contacts; and a second input conductive wire, wherein the first input moveable contact wall connects to the first input conductive part via the first input conductive wire and the second input moveable contact wall connects to the second input conductive part via the second input conductive wire.

6. The circuit breaker of claim 5, further comprising:

a base;

a first clamp;

a first output static contact;

a second clamp; and a second output static contact, wherein:

the base connects with the first output static contact through the first clamp, the base connects with the second output static contact through the second clamp, the first output static contact corresponds to the first input moveable contact, and the second output static contact corresponds to the second input moveable contact.

7. The circuit breaker of claim 1, wherein the lock pin is metal.

8. The circuit breaker of claim 1, wherein the tripping button comprises a pressable button, and the tripping block, the loosening block slope and the pressable button form a unitary piece.

9. The circuit breaker of claim 1, wherein:

the resetting drawbar is a strip of material;

the hook is a ledge formed in the strip of material; and the ledge is perpendicular to at least one of the upper portion, the middle portion, or the lower end.

10. A circuit breaker, comprising:

a circuit board;

a resetting button comprising:

a locking device, the locking device comprising:

a resetting drawbar having an upper portion, a middle portion, and a lower end;

a hook at the lower end of the resetting drawbar;

a resetting spring on the upper portion of the resetting drawbar; and a tripping spring on the middle portion of the resetting drawbar;

a lock pin below the resetting drawbar, the lock pin comprising:

a horizontal portion with a lock pin slope;

a tripping button comprising:

a tripping device configured to selectively unlock-the locking device, the tripping device comprising:

a one piece tripping block with a loosening block slope, the loosening block slop configured to selectively contact the lock pin slope; and a moveable spring between the tripping block and the circuit board; and an elevator having an upper edge and a bottom edge, wherein the elevator houses the portion of the resetting drawbar covered by the tripping spring, and the hook aligns with the bottom of the elevator, and wherein the lock pin slope extends downward away from the horizontal portion and the horizontal portion selectively contacts the hook.

11. The circuit breaker of claim 10, further comprising:

a retractable device comprising a piston;

a mounting bracket for assembling the piston;

a coil rack;

a piston spring between the coil rack and the mounting bracket; and a solenoid coil covering the piston spring, wherein the piston connects to the lock pin and the piston spring connects to the piston.

12. The circuit breaker of claim 10, further comprising:

a lock bracket below the lock pin;

a lock moveable contact spring in the lock bracket; and a lock static contact spring in the lock bracket, wherein the lock pin further comprises a notch and the lower end of the hook passes through the notch.

13. The circuit breaker of claim 12, wherein:

the lower end of the hook is in a first position when the lower end of the hook is separated from the lock moveable contact spring, the lower end of the hook is in a second position when the lower end of the hook contacts the lock moveable contact spring, and the lower end of the hook is in a third position when the lower end of the hook is attached to the bottom of the elevator.

14. The circuit breaker of claim 10, further comprising:

an assembled magnet set comprising a first input conductive part and a second input conductive part;

a first input moveable contact wall on the elevator, the first input moveable contact wall comprising at least two first input moveable contacts;

a first input conductive wire;

a second moveable contact wall on the elevator, the second moveable contact wall comprising at least two second input moveable contacts; and a second input conductive wire, wherein the first input moveable contact wall connects to the first input conductive part via the first input conductive wire and the second input moveable contact wall connects to the second input conductive part via the second input conductive wire.

15. The circuit breaker of claim 14, further comprising:

a base;

a first clamp;

a first output static contact;

a second clamp; and a second output static contact, wherein:

the base connects with the first output static contact through the first clamp, the base connects with the second output static contact through the second clamp, the first output static contact corresponds to the first input moveable contact, and the second output static contact corresponds to the second input moveable contact.

16. The circuit breaker of claim 10, wherein the lock pin is metal.

17. The circuit breaker of claim 10, wherein the tripping button comprises a pressable button, and the tripping block, the loosening block slope and the pressable button form a unitary piece.

18. The circuit breaker of claim 10, wherein:

the resetting drawbar is a strip of material;

the hook is a ledge formed in the strip of material; and the ledge is perpendicular to at least one of the upper portion, the middle portion, or the lower end.

* * * * *